United States Patent [19]

Salzer

[11] 4,106,843

[45] Aug. 15, 1978

[54] DEVICE FOR ESTABLISHING ELECTRIC CONTACT PRESSURE

[75] Inventor: Erwin Salzer, Waban, Mass.

[73] Assignee: Gould Inc., Newburyport, Mass.

[21] Appl. No.: 721,084

[22] Filed: Sep. 7, 1976

[51] Int. Cl.[2] ..... H01R 9/18

[52] U.S. Cl. ..... 339/232; 339/263 R

[58] Field of Search ..... 339/231, 232, 263 R, 339/263 L; 85/32 R, 32 UN

[56] References Cited

U.S. PATENT DOCUMENTS

| | | | |
|---|---|---|---|
| 257,854 | 5/1882 | Dillon | 85/32 R |
| 1,374,615 | 4/1921 | Talty | 85/32 R X |

FOREIGN PATENT DOCUMENTS

| | | | |
|---|---|---|---|
| 752,070 | 7/1956 | United Kingdom | 339/263 R |

*Primary Examiner*—Stephen Marcus
*Attorney, Agent, or Firm*—Erwin Salzer

[57] ABSTRACT

Contact pressure is established by means of two screw-nuts mounted on a stud projecting from, and affixed to, a contact member. There is a first cooperating pair of screw-threads between said stud and a drive screw-nut and a second cooperating pair of screw-threads between said drive screw-nut and a driven screw-nut. All screw-threads are oriented in such a way that the axial movements of said driven screw-nut relative to said stud are the sum of the axial movements of said drive screw-nut relative to said stud plus the relative axial movements of said drive screw-nut and said driven screw-nut. Means are provided for inhibiting any relative rotary motions of said driven screw-nut and said stud.

7 Claims, 10 Drawing Figures

DEVICE FOR ESTABLISHING ELECTRIC CONTACT PRESSURE

BACKGROUND OF THE INVENTION

Butt contacts have many advantages and many limitations, e.g. as means for insertion of high current-carrying-capacity fuses into electric circuits.

As seen in considerable magnification, the cooperating surfaces, or overlapping surfaces, of a pair of engaging butt contacts are highly irregular arrays of projections. Current transfer from one of the engaging contacts is limited to the areas of these projections. These areas are but a very small fraction of the total area of overlap of a pair of mutually engaging butt contacts. It is thus apparent from the above that butt contacts are very inefficient in terms of area, area efficiency being the ratio of the sum of the areas of actual current-transfer to the total contact area, or that of contact overlaps.

Contact resistance at each current transferring projection depends upon a number of parameters and is difficult to determine with any degree of accuracy. Important parameters that determine the contact resistance at discrete spaced points of current transfer are contact pressure and hardness of the metal of which the contacts are made. The contact pressure may vary within wide limits and result in elastic deformation of some of the current transferring projections and in plastic deformation of others of these projections.

It is apparent from the above that the aggregate resistance of a pair of engaging butt contacts is roughly inversely proportional to the extent of their overlapping surfaces, the number of points where pressure is applied to the contacts, i.e. the number of clamping screws which exert pressure upon the contacts at spaced points thereof, and to the extent or magnitude of that pressure.

The cost of butt contacts are relatively small, and their resistance is relatively stable. Both these facts are significant advantages of this type of contacts.

The limitations of butt contacts are apparent from what has been said above. They require large areas of overlap which may result in highly undesirable bulk. They further require, when the current to be carried is high, a plurality of clamping screws which to tighten or untighten involves much time.

It is the principal object of this invention to provide compact contact clamping means capable of establishing high contact pressures, in particular to provide fuse holders for fuses having a high current-carrying capacity, but relatively small contact surfaces. In other words, the contact surfaces of fuses according to the present invention may be smaller than that of fuses having conventional butt contacts designed for a comparable current-carrying duty. Fuses embodying the present invention have screw means capable of establishing large contact pressures and capable of being rapidly tightened and untightened so as to minimize the downtime normally involved in the exchange of fuses.

SUMMARY OF THE INVENTION

A device according to this invention for establishing contact pressure between current-carrying contacts comprises a contact member, a stud projecting from, and affixed to, said contact member, a drive screw-nut and a driven screw-nut. The stud is provided with an external screw-thread at the end thereof remote from the contact surface of the contact member. The drive nut is mounted on said stud and has a screw-thread cooperatively engaging said screw-thread on said stud, and further has an additional screw-thread. The driven nut is slidably mounted on said stud, and it has a screw-thread cooperatively engaging said additional screw-thread on said drive screw-nut. The two cooperating pairs of screw-threads are oriented in such a way that the axial movements of said driven screw-nut relative to said stud is the sum of the axial movements of said drive screw-nut relative to said stud plus the axial movements of said driven screw-nut relative to said drive screw-nut. The invention further includes means for precluding rotation of said driven screw-nut around said stud in response to rotation of said drive screw-nut around said stud.

DESCRIPTION OF PREFERRED EMBODIMENT

Figures 1, 2, 3, 4, 4A, 5, 6:
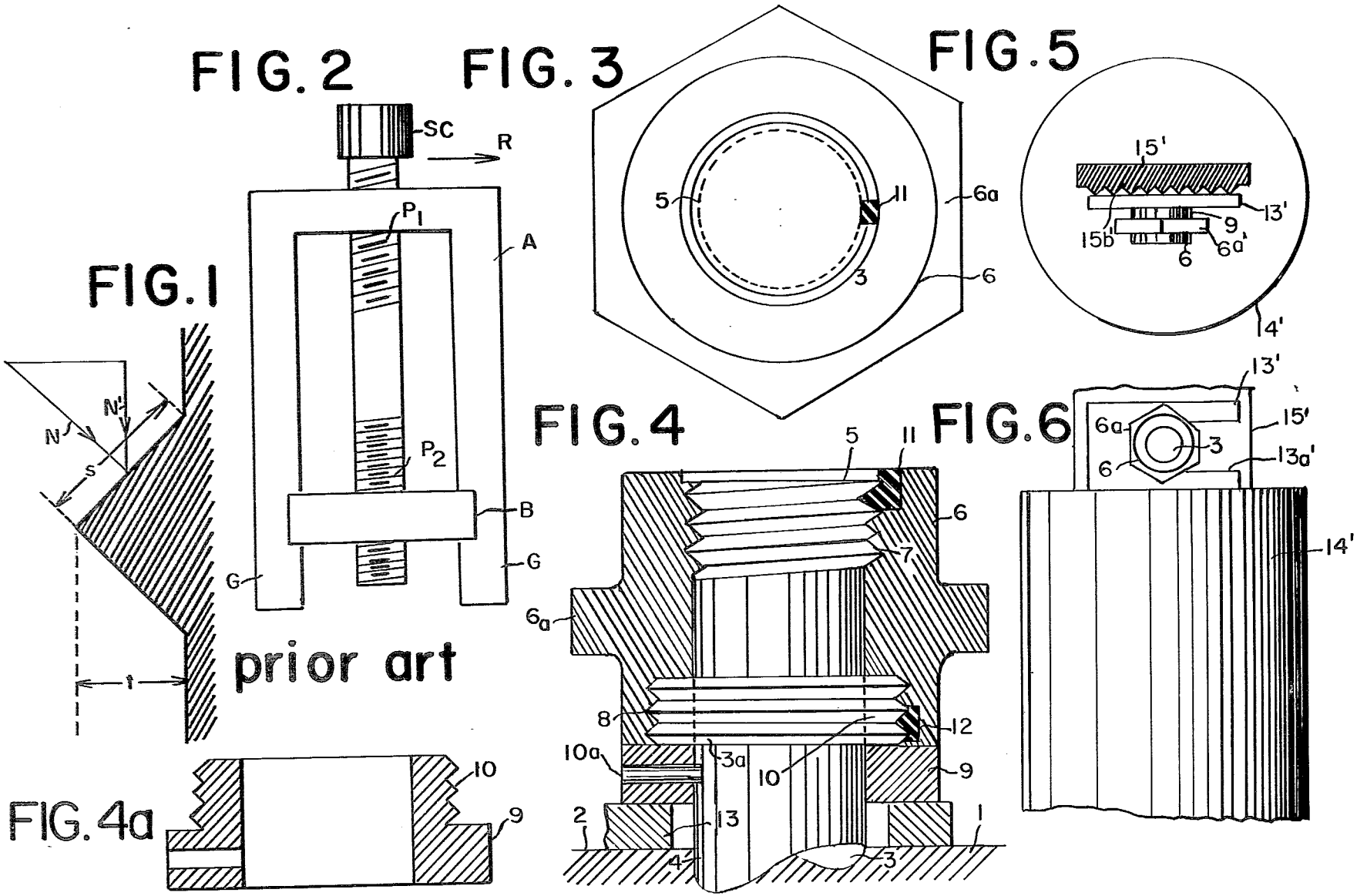
FIG. 1 prior art
FIG. 1 shows diagrammatically a screw thread.
FIG. 2 shows diagrammatically a prior art differential or compound screw.
FIG. 3 is a top plan view of a screw embodying the present invention.
FIG. 4 is partly a longitudinal section and partly an elevation of a screw embodying the present invention.
FIG. 4*a* is a longitudinal section of a detail.
FIG. 5 is a top plan view of a fuse mounted on a bus bar.
FIG. 6 is a side elevation of a portion of the fuse according to FIG. 5.

In FIG. 1,

N is the force acting at right angles upon the surface of a screw;

N′ is the projection of N upon the axis of the screw;

$t$ is the depth of the threads of the screw; and $s$ is the length of threads.

Assuming that the pitch of the screw is small, the following equation represents a fair approximation:

$$N'/N = (t/s); \tag{1}$$

Consequently $$N' = N(t/s). \tag{2}$$

Summarizing all components parallel to N′ yields $$\Sigma N' = Q; \tag{3}$$

Consequently $$\Sigma N = \Sigma N' \cdot (s/t) \tag{4a}$$

$$\Sigma N = Q \cdot (s/t). \tag{4b}$$

The sum of all frictional forces $F = \Sigma F$.

$$\Sigma F = \Sigma N \cdot \mu \tag{5a}$$

$$\Sigma F = (s/t) \cdot Q \cdot \mu \tag{5b}$$

where $\mu$ is the coefficient of friction.

Referring as P the force required to turn or pivot the screw, and as $p$ the length of the lever arm of P yields the term for the drive torque $P \cdot p$. If $h$ is the height of one full turn of the screw, its work function may be expressed by the equation $$P \cdot p \cdot 2\pi = Q \cdot h + (s/t) \cdot Q \cdot \mu \cdot l \quad (6)$$

wherein $l$ is the median length of one turn of the screw.

If there is no friction $\mu = 0$ and the above equation takes the form $$P \cdot p \cdot 2 \cdot \pi = Q \cdot h \quad (6a)$$

The efficiency $\gamma$ of a screw is $$\gamma = \frac{h}{h + \frac{s}{t} \cdot \mu \cdot 1} \quad (7)$$

In a fastening screw $\gamma$ should be small and hence $(s/t) \cdot \mu \cdot l$ large. This means that $(s/t)$ or the pitch of the screw be small and $l$, i.e. the average diameter of screw thread, large.

On the other hand, quick tightening and release of a screw would require a large pitch.

Both incompatible conditions can be met by resorting to a compound screw system.

Since this invention is predicated upon the use of compound or differential screws, this type of screws is shown in FIG. 2.

FIG. 2 shows a fixed nut A supporting screw-threaded stud SC on which movable nut B is mounted. The latter is free to slide along guides G,G. Assuming that the pitch of the cooperating threads of A and SC is $P_1$ and the pitch of the cooperating threads of B and SC is $P_2$, that both threads are right-handed and that $P_1 > P_2$. For each turn of stud SC in the direction of arrow R there is an advance of Stud SC downward equal to $P_1$ and a movement of nut B relative to stud SC upward equal to $P_2$. Thus the absolute motion of B to the right is $P_1 - P_2$. Hence the term differential screw. If the cooperating threads of A and SC are right-handed and the cooperating threads of B and SC are left-handed, then the absolute motion of B in regard to stud SC should be $P_1 + P_2$.

This principle has been applied in the structure shown in FIGS. 3 and 4.

Referring now to FIGS. 3 and 4, numeral 1 has been applied to indicate a contact member having a contact surface 2. Stud 3 is affixed to, and projects from, contact member 1. Stud 3 is not a current-carrying part and, therefore, does not need to be made of a metal having a high conductivity. The metal of which stud 3 is made should have a high tensile strength. As shown in FIG. 4, contact member 1 has a bore 4 into which stud 3 is inserted and by reason of which stud 3 is affixed to contact member 1. The end of stud 3 remote from contact member 1 has a screw-thread 5. The drive nut 6 is mounted on stud 3 and has internal first screw-thread 7 cooperatively engaging the external screw thread 5 on stud 3. Drive nut 6 is cylindrical but is provided with a hexagonal collar 6a which greatly facilitates its manipulation. Drive nut 6 is further provided with a second screw thread 8 which, in the embodiment of the invention shown in FIG. 4, is an internal screw-thread. Reference numeral 9 has been applied to a driven screw-threaded nut which derives its name from the fact that it is driven by driving nut 6. FIG. 4 shows the upper portion of nut 9 in elevation and the lower portion of nut 9 in section, while FIG. 4a shows both the upper and lower portion of screw 9 sectionalized. Nut 9 is slidably mounted on stud 3 and has a screw-thread 10 cooperatively engaging said screw-thread 8 on driving nut 6. Screw-threads 5,7 and 8,10 are oriented in such a way that any axial movements of said driven screw-nut 9 relative to said stud 3 is the sum of the axial movements of said drive screw 6 relative to said stud 3 and of the axial movements of said driven screw 9 relative to said drive screw 6. Stud 3 is provided with a groove 3a engaged by the radially inner end of pin 10a. This inhibits any rotary motion of screw-nut 9, i.e. screw-nut 9 is only driven axially by screw-nut 6, but cannot follow the rotary motion of nut 6. If the length of groove 3a is limited, this limits also the possible displacement of nut 6 in a direction longitudinally of stud 3.

The provision of locking elements 11 and 12 is optional. Locking elements 11 and 12 are strips of a plastic material fused to the screw threads. The locking action is developed through friction and interference of the plastic locking element and the mating threads of the tapped nut. The resulting reaction presses the screw against the opposite side of the hole, developing a high frictional force between the mating threads that lock the fastener securely.

It should be observed that the pitch of screw-threads 5,7 is inverse to the pitch of screw-threads 8,10. If the one is clockwise, the other is counterclockwise. Furthermore the ptich of screw-threads 5,7 and that of screw-threads 8,10 differ from each other. Assuming that the pitch of threads 5,7 exceeds that of the threads 8,10 and that a given torque is applied to the hex-nut 6. Then hex-nut 6 or screw-threads 5,77 may perform the rough adjustment of the width of the gap between parts 1 and 9 and nut 9 or screw-threads 8,10 may perform the fine adjustment of the width of said gap. Normally a contact member 13 will be inserted into said gap and the latter will be clamped between the base surface of nut 9 and the top surface of contact member 1.

Referring now to FIGS. 5 and 6, the fuse 14' is clamped by screw means of the type shown in FIGS. 4 and 5 against bar terminals 15'. The latter are provided with a system of parallel ridges 15b' which rest against the rear surfaces of the blade contacts 13' of fuse 14'. The blade contacts 13' are provided with slots 13a' allowing insertion and removal of fuses 14' without removal from studs 3 of nuts 6 and 9. There are instances where the arrangement of fuses as shown in FIGS. 5 and 6 is inconvenient because it requires a relatively large lateral displacement of the fuses. Then the arrangement shown in FIGS. 7–9 may be resorted to.

The blade contacts 13' may be planar on both sides and thus inexpensive to manufacture. The ridges 15b' dig into the flat blade contacts and tend to increase the contact efficiency, i.e. the ratio of the sum of the areas of actual current transfer to the contact area, or that of contact overlap.

Contacts as shown in FIG. 5 comply approximately with the equation $$R_R = \frac{\sqrt{\pi}}{2} \cdot \rho \cdot \frac{H}{F}$$

wherein $R_R$ = contact resistance per ridge $\rho$ = specific resistance

H = hardness of the contact material and

F = contact pressure.

Figure 9:
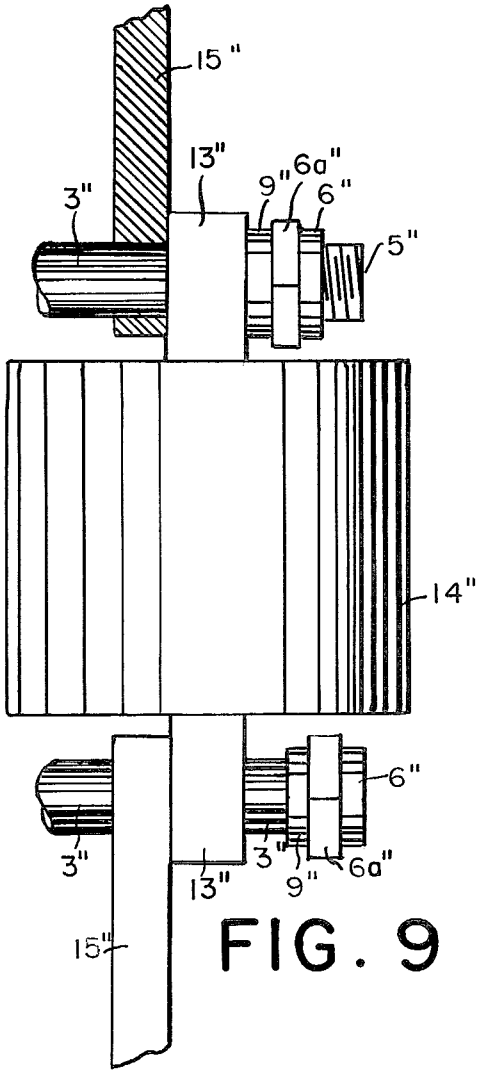
FIG. 9 is a side elevation of the structure of FIG. 8.
Figure 8:
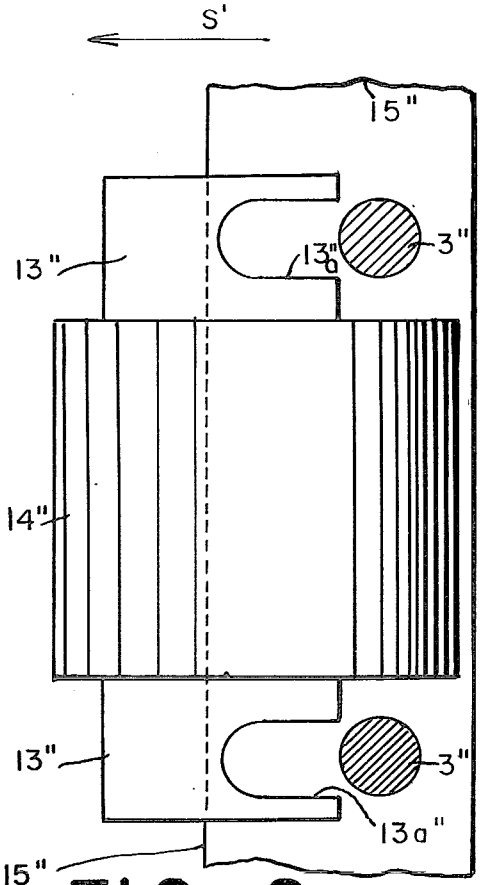
FIG. 8 shows the arrangement of FIG. 7 while the fuse is in the process of being removed.
Figure 7:
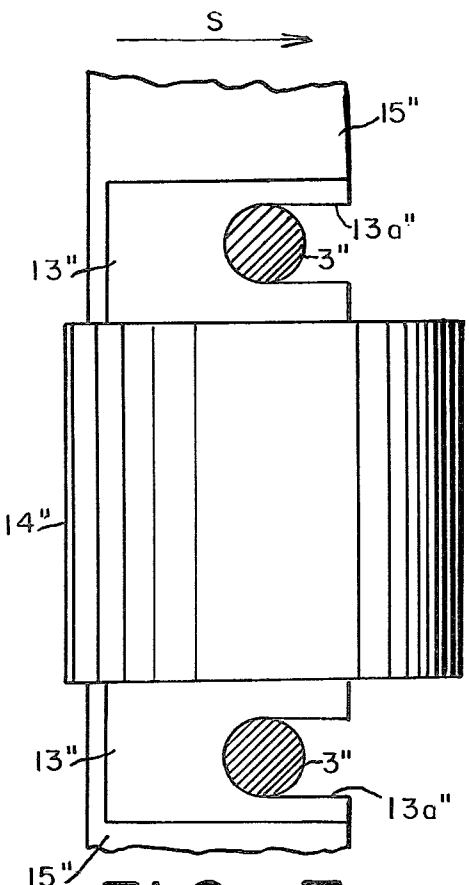
FIG. 7 shows a fuse mounted on buses that are parallel to the blade contacts of the fuse.

Referring now to FIGS. 7–9, numerals 14″ have been applied to indicate the fuses proper, numerals 13″ to indicate their blade contacts, and numerals **13*a*″ the slots provided in the blade contacts for receiving the studs 3″. The blade contacts 13″ engage the contacts 15″, i.e. they abut against the latter, the contact pressure being exerted by differential screw units 6″, 9″ shown in detail in FIGS. 3 and 4. In FIG. 7 the arrow S indicates the direction in which the fuse is inserted and in FIG. 8** the arrow S′ indicates the direction in which the fuse is withdrawn.

In FIG. 4 the proportions have only been indicated diagrammatically. The number of threads 5,7 and the number of threads 8,10 is dictated by the pressure to be exerted by nut 9 upon part 13 and the surface of contact 1. The height of groove **3*a* should but slightly exceed the thickness of part or blade contact 13 so that the angle which drive screw 6 must be turned to firmly clamps part 13, e.g. a blade contact, between parts 1 and 9** may be smaller than 270°, preferably only 90°.

In other words, assuming the blade contacts 13,13′ or 13″ have a thickness of Δ, then the travel of driven nut 9,9′,9″ should hardly exceed Δ, while the height along which the screw-threads 5,7 and 8,10 engage, ought to exceed Δ by far.

It will be apparent from the above that the structure disclosed permits faster tightening or clamping of a contact such as, e.g. contact 13″ of FIGS. 7–9. The claim that applicant's device is capable of producing high contact pressures is based on the fact that under otherwise equal conditions greater pressures can be produced with compound screws than with single bolts and nuts, as clearly explained above.

I claim as my invention:

1. A device for establishing electrical contact pressure between a pair of mutually engaging current-carrying contact members including (a) a contact member having a contact surface;

(b) a stud projecting from and affixed to said contact member, said stud having an external screw-thread at the end thereof remote from said contact member;

(c) a drive-nut mounted on said stud and having a first screw-thread cooperatively engaging said screw-thread on said stud and further having a second screw-thread;

(d) a driven nut slidably mounted on said stud cooperatively engaging said second screw-thread;

(e) said screw-thread on said stud and said screw-threads on said drive nut and on said driven nut being oriented in such a way that the axial movements of said driven nut relative to said stud is the sum of the axial movements of said drive nut relative to said stud plus the axial movements of said driven nut relative to said drive nut; and (f) means precluding rotation of said driven nut around said stud in response to rotation of said drive nut around said stud.

2. A device as specified in claim 1 including means for limiting the axial travel of said driven nut relative to said stud.

3. A pressure contact including in combination (a) a first contact member;

(b) a stud projecting at right angles from said first contact member and having a clockwise screw-threaded end remote from said first contact member;

(c) a second contact member engaging said first contact member under pressure and having an aperture through which said stud projects;

(d) a nut loosely mounted on said stud and having a counter-clockwise screw-thread and means precluding rotation of said nut around said stud; and (e) an additional nut having a counter-clockwise screw-thread engaging said screw-thread of said nut, and said additional nut further having a clockwise screw-thread engaging said screw-threaded end of said stud.

4. A pressure contact as specified in claim 3 wherein said screw-thread on said stud and said screw-thread on said nut have a different pitch.

5. A pressure contact including (a) a contact member;

(b) a stud projecting at right angles from said contact member and having a screw-threaded end remote from said contact member;

(c) a driving screw-nut rotatably mounted on said screw-threaded end of said stud and having an additional screw-thread;

(d) a driven screw-nut mounted on the non-screw-threaded portion of said stud and having a screw-thread engaging said additional screw-thread of said driving screw-nut;

(e) said screw-threaded end of said stud and said screw-thread on said driven screw-nut having an opposite pitch; and (f) means compelling said driven screw-nut to move along a straight path only and precluding rotation thereof.

6. A pressure contact as specified in claim 5 wherein said means compelling said driven screw-nut to move along a straight path only include an axial groove provided in said stud and a radial pin provided in said driven screw-nut and having an end projecting into said groove.

7. A pressure contact as specified in claim 6 wherein said contact member is engaged by the blade contact of an electric fuse and wherein the length of said groove barely exceeds the thickness of said blade contact of said fuse.

* * * * *